United States Patent [19]

Kolm et al.

[11] Patent Number: 4,549,115

[45] **Date of Patent: * Oct. 22, 1985**

[54] HEAT-SENSITIVE VARIABLE-RESISTANCE LIGHT SOCKET INSERT WITH RESILIENT CONTACT

[75] Inventors: Eric A. Kolm, Brookline; Henry H. Kolm, Wayland, both of Mass.

[73] Assignee: Piezo Electric Products, Inc., Cambridge, Mass.

[ * ] Notice: The portion of the term of this patent subsequent to Apr. 2, 2002 has been disclaimed.

[21] Appl. No.: 480,354

[22] Filed: Mar. 30, 1983

[51] Int. Cl.[4] ..... H01J 7/44; H05B 37/00

[52] U.S. Cl. ..... 315/71; 315/32; 315/200 R; 315/309

[58] Field of Search ..... 315/32, 21, 200 R, 205, 315/309; 338/219

[56] References Cited

U.S. PATENT DOCUMENTS

| | | | |
|---|---|---|---|
| 3,333,224 | 7/1967 | Rosenblatt | 338/219 |
| 3,467,937 | 9/1969 | Norton | 315/71 |
| 4,229,680 | 10/1980 | Berlin et al. | 315/200 R |
| 4,435,671 | 3/1984 | Wouk | 315/71 |

*Primary Examiner*—Harold Dixon

*Attorney, Agent, or Firm*—Joseph S. Iandiorio; William E. Noonan

[57] ABSTRACT

A heat-sensitive variable-resistance insert device for use with a light bulb and socket, including: a heat-sensitive variable-resistance wafer for interconnecting the central contact of the socket with the central contact of the light bulb. An annular insulation member surrounds the edge of the wafer and electrically insulates it from the wall of the socket. A resilient contact is mounted on at least one side of the wafer for resiliently engaging the associated central contact and accommodating for variations in the distance between the central contacts.

19 Claims, 4 Drawing Figures

HEAT-SENSITIVE VARIABLE-RESISTANCE LIGHT SOCKET INSERT WITH RESILIENT CONTACT

FIELD OF INVENTION

This invention relates to a heat-sensitive variable-resistance insert device for use with a light bulb and socket and in particular to such a device having at least one resilient contact.

BACKGROUND OF INVENTION

When an electric light bulb is turned on, a sudden incoming surge of electrical current encounters the relatively low resistance (e.g. 3 ohms) typically exhibited by the cold filament. The resistance of the cold filament may be only 1/41 of that of its resistance (e.g. 125 ohms) at operating temperature, so that the initial current surge is forty-one times that of the operating current. Consequently, a weak or worn filament will often burn out at the moment the bulb is turned on. To remedy this problem and prolong light bulb life, various heat-sensitive variable-resistance light socket insert devices are presently known. Typically, such devices include a thermistor element having contact surfaces on either side thereof, which is interposed between the light socket and bulb contacts. When it is cold (e.g. when the electricity is turned off), the insert device exhibits a resistance which is typically higher than the normal operating resistance of the bulb filament. Accordingly, when the light bulb is turned on, the initial current surge through the filament is reduced by the insert device. As the insert device is heated by the current, its resistance drops so that the normal operating current is delivered to the filament. By then, the filament has attained its normal operating resistance.

Occasionally, however, the variable resistance insert device does not make good contact with the central contact of the light bulb and/or that of the socket. For example, the light bulb may exhibit a relatively flat base which is contoured such that the central contact does not protrude sufficiently therefrom. Accordingly, when the bulb is fully screwed into the socket, the bulb center contact does not engage the upper contact surface of the insert device. Further, where the light socket central contact has become "tired" and lost its resiliency, it may tend to flatten and thus lose touch with the bottom surface contact area of the insert device. Such faulty connection with the light socket contact may also be caused by rivets which protrude from the base of the light socket and thereby interfere with seating of the insert device close enough to the socket contact so that the socket contact is unable to engage the bottom surface contact area of the insert device.

SUMMARY OF INVENTION

It is, therefore, an object of this invention to provide an improved heat-sensitive variable-resistance device for use with a light bulb and socket which engages and makes good electrical contact with light bulb and/or socket contacts which are otherwise inaccessible.

It is a further object of this invention to provide a light socket insert which provides for good electrical connection between light bulb and socket contacts having a larger than normal gap therebetween.

It is a further object of this invention to provide a light socket insert which engages and provides good electrical contact with the central contact of a light bulb having a shallow base.

It is a further object of this invention to provide a light socket insert which engages and provides good electrical contact with even a weakened central contact of a light socket.

This invention features a heat-sensitive variable-resistance insert device for use with a light bulb and socket, including a heat-sensitive variable-resistance wafer for interconnecting the central contact of the socket with the central contact of the light bulb. A perimetrical insulation member surrounds the edge of the wafer and electrically insulates it from the wall of the socket. A resilient contact is mounted on one side of the wafer for resiliently engaging the associated central contact and accommodating for variations in the distance between the central contacts.

In a preferred embodiment, a second resilient contact may be mounted on the other side of the wafer. The wafer may be circular and the insulation member disposed annularly thereabout. The insulation member may be resilient and may include an elastomeric material; alternatively, the insulation member may include a ceramic material. The insulation member may include a plurality of resilient elements on at least one side thereof to cushion the member against the base of the socket. The resilient contact may include a rounded dish and the outer edge of the dish may engage the wafer.

An adhesive paste may be provided on the resilient contact for adhering the device to the base of a light bulb. The resilient contact may be perforate and an adhesive paste may be included between it and the wafer. Such an adhesive paste may be a two-part catalytically activated adhesive with the two parts mounted adjacent to each other. Alternatively, the adhesive paste may be a heat setting bonding paste. The paste may be viscid and temporarily adhere the wafer to the base of the bulb until the paste fully sets. The paste may be provided in an annular configuration on the wafer to enable the contact of the bulb to extend through the central hole thereof to contact the wafer. A plurality of resilient elements may be provided on at least one side of the annular member.

This invention may also feature a heat-sensitive variable-resistance insert device such as heretofore described which includes first and second resilient contacts, one mounted on each side of the wafer for resiliently engaging the associated central contacts and for accommodating for variations in the distance between the central contacts. Each of such resilient contacts may include a rounded dish and the outer edge of each such dish may engage the wafer.

DISCLOSURE OF PREFERRED EMBODIMENT

Other objects, features and advantages will occur from the following description of a preferred embodiment and the accompanying drawings, in which.

Figure 1:
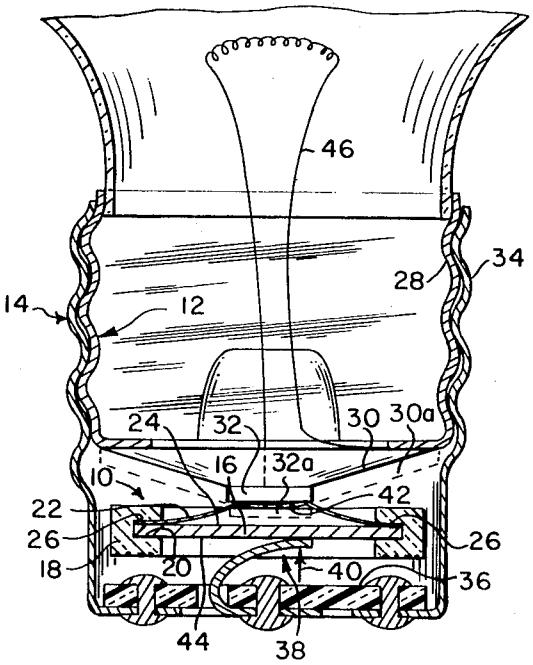
FIG. 1 is an elevational cross-sectional view of the insert device of this invention inserted in a light socket and interposed between the light bulb and socket central contacts.

A heat-sensitive variable-resistance insert device for use with a light bulb and socket according to this invention may be effected using a circular heat-sensitive variable-resistance wafer for interconnecting the central contact of the socket with the central contact of the light bulb. The wafer is preferably composed of a thermistor ceramic which may include a mixture of manganese dioxide ($MnO_2$) and nickel oxide (NiO). Preferred proportions include 85–90% manganese dioxide 10–15% nickel oxide.

A perimetrical, typically annular insulation member surrounds the edge of the wafer and electrically insulates it from the wall of the socket. The insulation member may be an elastomeric material such as silicone rubber or other material such as ceramic which is capable of withstanding the operating temperature of the bulb. The insulation member typically has a diameter which is smaller than that of the socket, thereby enabling interference free insertion and removal of the insert device into and out of the light socket.

A resilient contact is provided on one side of the wafer for resiliently engaging the central contact of either the light bulb or the light socket and for accommodating variations in the distance between those central contacts. Typically, the resilient contact includes a rounded dish composed of material such as hard rolled copper, brass, phosphor bronze, berilium bronze, stainless steel, or any other elastic metal. The outer edge of the metal dish engages and makes electrical contact with the contact area on one side of the wafer and is slightly smaller than that of the wafer. The dish is arranged so that it faces convexly away from the wafer in either a direction facing the light bulb contact or facing the light socket contact, as required. Where the device of this invention is utilized in a conventional electric light socket, the resilient contact is typically very thin, having a thickness of approximately 0.002–0.010 inches.

An adhesive paste may be provided on the resilient contact for adhering the device to the base of a light bulb. This paste may include a two-part catalytically activated adhesive such as used in autobody repairs and the like. The two parts are mounted adjacent to each other on the wafer. Such a paste may be viscid and temporarily adhere the wafer to the base of the bulb until the paste is mixed by the action of screwing the bulb into the socket and then fully sets. Alternatively, the paste may be a heat setting bonding paste. However, because such heat setting bonding pastes often exhibit a limited shelf life (hardening after one or two years of non-use), the two-part adhesive is preferred. Such two-part pastes, which are often available in the form of two-layer ribbons, typically remain effective for an indefinite period because of a very thin skin which forms between the two layers and prevents mixing and thus setting thereof. In one embodiment, the paste may be applied to the wafer in an annular configuration so that the bulb contact extends through the annular hole to contact the wafer. Where the two-part adhesive is employed, such an annular paste may be divided into two semi-annular halves, each comprising one of the two catalytically activated parts. Although it is preferred to apply the adhesive paste directly on top of the resilient contact, alternatively the resilient contact may be perforated and paste may be provided between it and the wafer. In such an embodiment, the paste protrudes through the perforations and enables a permanent attachment of both the wafer and the resilient contact to the base of the light bulb so that separation can not be effected without destroying the wafer and rendering it unfit for re-use. Where the adhesive paste is employed to adhere the device to the light bulb prior to insertion of the bulb in the light socket, the need for tools or fingers to insert the device in the socket is eliminated. Safety against electrical shock is thus greatly enhanced.

Where a resilient insulation member is employed, a plurality of resilient elements may be provided on at least one of the surfaces of the annular insulation member. Typically, such elements include fingers formed by making multiple crossing radial and annular serrations on the surface faced away from the light bulb. When the light bulb is screwed into the socket, the fingers are urged against one or more rivets which often protrude from the base of a light socket. Consequently, the insulation member is cushioned against such rivets. The light socket insert described above may be employed to engage and provide good contact with the central contact of either the light bulb or socket. For example, where the bulb contact would otherwise be inaccessible to the insert device (such as where the bulb has a shallow base), the device of this invention may be inserted so that the resilient contact faces the bulb contact. Alternatively, if the socket contact would be otherwise inaccessible to an insert device (such as where the socket contact is weak or collapsed), the device of this invention is reversed so that the resilient contact faces the socket contact.

This invention also includes a light socket insert device such as has been described which includes first and second resilient contacts. One such contact is mounted on each side of the heat-sensitive variable-resistance wafer. Each contact is provided for resiliently engaging an associated central contact and for accommodating for variations in the distance between the bulb and socket contacts. Typically, the contacts are convex with the outer edge contacting the respective sides of the wafer. By utilizing the embodiment of this invention having two resilient contacts, good contact can be made where both the light bulb and socket contacts would be otherwise inaccessible to the contact areas of the light socket insert device. Further, such an insert may be installed in a light socket without the need for determining whether the bulb contact or the socket contact is the cause of the bad electrical connection.

There is shown in FIG. 1 a heat-sensitive variable-resistance insert device 10 which is used with a light bulb 12 and a socket 14 according to this invention. Device 10 includes a heat-sensitive variable-resistance wafer 16 which exhibits a high resistance when cold and which drops to a low resistance as it is heated.

Figure 2:
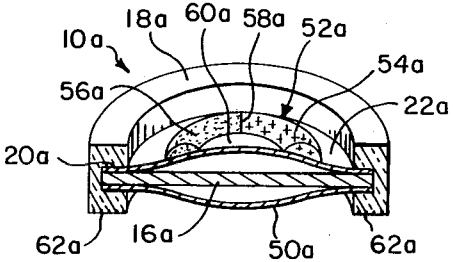
FIG. 2 is an axonometric sectional view of an insert device according to this invention having a pair of resilient contacts and an adhesive paste arranged in an annular configuration on one of the resilient contacts.

Wafer 16 is circular, as is shown more clearly by wafer **16*a* in FIG. 2. An annular insulation member 18, FIG. 1, typically composed of a resilient elastomeric material such as silicone rubber, surrounds the edge of wafer 16. Member 18 includes a channel 20 for receiving the circumferential edge of the wafer and has a diameter which is slightly smaller than that of socket 14. A resilient metal contact 22 is mounted so as to be in electrical and thermal contact with the top contact surface 24 of wafer 16. In particular, contact 22 is convex and faces convexly in the direction opposite wafer 16. The outer edge 26 of convex contact 22 is fitted into channel 20 of insulation member 18 and is therein held in contact with surface 24 of wafer 16**.

Bulb 12 includes a threaded periphery 28 and a base 30 which has a central bulb contact 32 at the bottom thereof.

Socket 14 includes a threaded inside periphery 34 and a socket base 36. A springy central socket contact 38 is mounted in a conventional manner to base 36 and is biased upwardly in the direction of arrow 40.

Bulb 12 is shown screwed into socket 14 with device 10 interposed between central bulb contact 32 and central socket contact 38. Light socket inserts of the prior art require that contact be made between the central contacts and respective sides of the heat-sensitive variable-resistance wafer. No resilient contact 22 is provided in such devices. Certain bulbs have protruding bases 30*a* which extend into the socket 14 deeply enough so that their central contact 32*a* engages and makes good contact with the top contact surface 24 of the wafer 16. However, where bulb 12 includes a relatively shallow base 30, the contact 32 does not extend deeply enough into the socket to contact the wafer. The insert device is thus rendered useless. This problem is remedied, however, by device 10 of the present invention. Resilient contact 22 is biased upwardly to engage and make good contact with central contact 32 of the relatively shallow light bulb base 30. Because the contact 22 is in thermal and electrical contact with wafer 16, the wafer is electrically connected to the central bulb contact 32. Bulb 12 extends deeply enough into socket 14 so that contact 32 bears against the top of resilient contact 22 and thereby causes a depression or dimple 42 proximate the top of the resilient contact 22. The socket contact 38 is biased against and makes good contact with the bottom surface contact area 44 of wafer 16.

When wafer 16 is cold, it exhibits a relatively high resistance (typically 125 ohms). When the bulb is energized, current passes from socket contact 38 through wafer 16 and resilient contact 22 to bulb contact 32. The high resistance of cold wafer 16 reduces the inital current entering bulb 12 and therefore reduces the initial current surge. Insulation member 18 insulates wafer 16 from the inside wall 34 of socket 14.

Device 10 may also be utilized when socket contact 38 is weak or collapsed, and does not contact the bottom surface 44 of wafer 16 in the manner shown in FIG. 1, e.g. when there is a gap between contact 38 and wafer 16. To remedy this problem, device 10 is merely flipped over or reversed, so that resilient contact 22 faces and engages socket contact 38 and makes good contact with it.

There is shown in FIG. 2 an insert device 10*a* having resilient convex contacts 22*a* and 50*a* mounted on both sides of heat-sensitive variable-resistance wafer 16*a*. Each of the contacts 22*a*, 50*a* includes a thermally and electrically conducting resilient metal. The circumferential edges of the contacts are fitted within channel 20*a* of insulation member 18*a* and are therein held in thermal and electrical contact with the respective sides of wafer 16*a*. Contacts 22*a* and 50*a* face convexly in a direction opposite from wafer 16*a*.

Device 10 may be attached to the base of a light bulb by means of an adhesive two-part paste 52*a* which is applied to the top surface of resilient contact 22*a* within annular insulation member 18*a*. The use of adhesive paste to attach a light socket insert to a light bulb prior to insertion in the light socket is described in detail in a patent application entitled "Heat-Sensitive Variable-Resistance Light Socket Insert", by Henry H. Kolm and Eric A. Kolm, filed on even date herewith, Ser. No. 480,346, which is incorporated herein by reference. Paste 52*a* is a two-part catalytically activated adhesive which includes a first part 54*a* and a second part 56*a* separated by a thin skin 58*a* which prevents mixing of parts 54*a* and 56*a* and premature setting of paste 52*a*. Paste 52*a* is shown applied in an annular configuration, wherein each of the parts 54*a*, 56*a* forms a one-half annular portion. A non-annular (e.g. substantially circular) configuration may also be provided.

Device 10*a* may be attached to base 30 of a light bulb 12, as in FIG. 1, prior to insertion into light socket 14. The central contact 32 extends through the central area 60*a*, FIG. 2, inside of paste 52*a* and engages the resilient contact 22*a*. Paste 52*a* comes into contact with bulb base 30, and because the paste is viscid it temporarily adheres device 10*a* to base 30. As light bulb 12 is screwed into socket 14 parts 54*a* and 56*a* and paste 52*a* are mixed as is described in patent application Ser. No. 480,346, thereby causing the paste to set and permanently bond device 10*a* to bulb 12. A single-component heat-setting paste may also be utilized and such a paste sets following heating and permanently bonds the light socket insert to the base of the light bulb.

A plurality of resilient elements 62*a* are provided in the bottom surface of insulation member 18*a*. When device 10*a* is inserted into a light bulb socket and member 18*a* is urged against the socket base, elements 62*a* provide a cushion against rivets which may protrude from the socket base.

Figure 3:
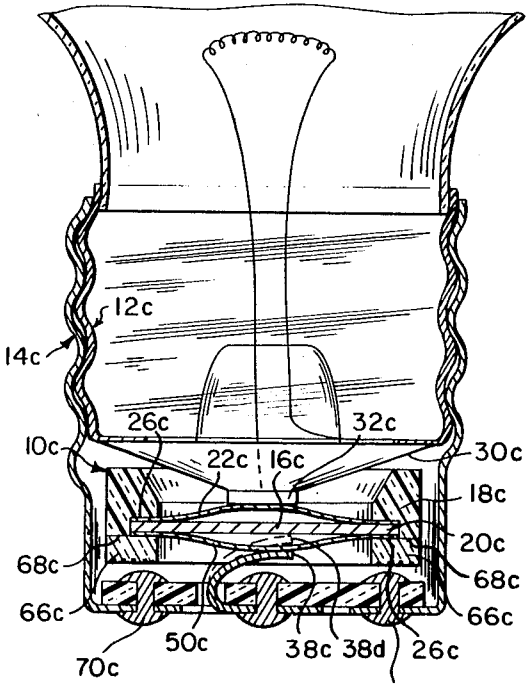
FIG. 3 is an elevational cross-sectional view of a light socket insert device which employs a ceramic annular insulation member.

An alternative insert device 10*c* is shown in FIG. 3. A circular thermistor wafer 16*c* is surrounded by a ceramic insulation member 18*c*. Resilient contacts 22*c* and 50*c* are mounted on either side of wafer 16*c*. The resilient contacts are convex and their outer edges 26*c* are received within the channel 20*c* which also receives the outer edge of wafer 16*c*. Wafer 16*c* and contacts 22*c* and 50*c* are held in place within channel 20*c* by a thermosetting cement washer 66*c*, which is placed over an annular surface 68*c* of insulation member 18*c* and over the outer edge 26*c* of resilient contact 22*c*. Washer 66*c* is then heated and secured to insulation member 18*c*. Thermosetting washer 66*c* permanently locks wafer 16*c* within channel 20*c* of insulation member 18*c*, thereby preventing removal and independent re-use of wafer 16*c*. Device 10*c* is interposed between the contact 32*c* of bulb 12*c* and the socket contact 38*c*. Bulb 12*c* includes a flat base which would not normally engage the upper surface contact area of heat-sensitive variable-resistance wafers of the prior art. However, resilient contact 22*c* provided by this invention faces convexly toward and engages contact 32*c*. Where the socket contact 38*d* is in good condition and biased upwardly to engage the bottom surface of wafer 16*c*, a resilient contact 50*c* is not needed (see also the embodiment in FIG. 1). However, where the contact 38*c* is weak or collapsed, a gap may exist between wafer 16*c* and contact 38*c*. Resilient contact 50*c* eliminates this gap. Since resilient contacts 22*c* and 50*c* contact respective surfaces of wafer 16*c*, good electrical connection is provided between socket contact 38*c* and bulb contact 22*c*.

Device 10*c* and in particular thermo-setting washer 66*c* rests on top of rivets 70*c*, 72*c*, which protrude from the base of socket 14*c*. When the light socket insert devices of the prior art are used, such rivets may occasionally cause problems by preventing good contact from being made; they may prevent the insert from being lowered far enough into the socket so that contact can be made between the socket contact and the bottom surface contact area of the insert device. A gap will thus exist between the socket contact and the wafer. This is a problem similar to that caused by a weak or collapsed socket contact. The insert of this invention may be utilized to remedy this problem. A device such as 10*a*, 10*b* or 10*c*, FIGS. 1–3, may be inserted so that a resilient contact faces convexly toward and engages the socket contact, thereby compensating for the gap created by the protruding rivets.

Figure 4:
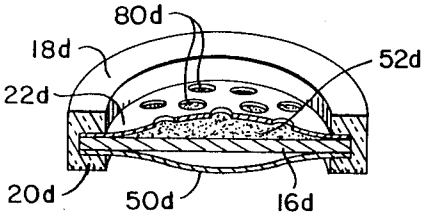
FIG. 4 is an axonometric sectional view of an alternative insert device which includes a pair of resilient contacts and in which one of the contacts is perforate and wherein an adhesive paste is provided between the wafer and the perforate resilient contact.

Insert device 10*d*, FIG. 4, is provided with a pair of resilient convex contacts 22*d*, 50*d*, mounted on either side of a heat-sensitive variable-resistance wafer 16*d*. A number of perforations 80*d* are provided through contact 22*d*. An adhesive paste is provided between wafer 16*d* and contact 22*d*. When device 10*d* is engaged by a light bulb base, adhesive 52*d* protrudes through perforations 80*d* and allows device 10*d* to adhere to the base of the bulb. As a result, the wafer 16*d* (which is typically thin) becomes permanently attached to the base of the light bulb and cannot be removed and reused independently of the bulb.

Other embodiments will occur to those skilled in the art and are within the following claims:

What is claimed is:

1. A heat-sensitive variable-resistance insert device for use with a light bulb and socket comprising:

a heat-sensitive variable-resistance wafer for interconnecting the central contact of the socket with the central contact of the light bulb;

a perimetrical insulation member surrounding the edge of said wafter and electrically insulating it from the wall of the socket; and a resilient convex disc contact on at least one side of said wafer having an outer edge which contacts said wafer for resiliently engaging the associated central contact and accommodating for variations in the distance between the central contacts.

2. The heat-sensitive variable-resistance insert device of claim 1 in which there is a second resilient contact on the other side of said wafer.

3. The heat-sensitive variable-resistance insert device of claim 1 in which said insulation member is resilient.

4. The heat-sensitive variable-resistance insert device of claim 3 in which said insulation member is an elastomeric material.

5. The heat-sensitive variable-resistance insert device of claim 1 in which said insulation member is a ceramic material.

6. The heat-sensitive variable-resistance insert device of claim 1 in which said wafer is circular and said insulation member is disposed annularly thereabout.

7. The heat-sensitive variable-resistance insert device of claim 1 further including an adhesive paste on said resilient contact for adhereing said device to the base of a light bulb.

8. The heat-sensitive variable-resistance insert device of claim 1 in which said resilient contact is perforate and there is an adhesive paste between it and said wafer.

9. The heat-sensitive variable-resistance insert device of claim 7 in which said paste is a two-part catalytically activated adhesive with the two parts mounted adjacent each other.

10. The heat-sensitive variable-resistance insert device of claim 9 in which said paste is viscid and temporarily adheres said wafer to the base of the bulb until the paste fully sets.

11. The heat-sensitive variable-resistance insert device of claim 7 in which said paste is a heat-setting bonding paste.

12. The heat-sensitive variable-resistance insert device of claim 7 in which said paste is provided in an annular configuration on said wafer to enable the contact of said bulb to extend through the center hole thereof to contact said wafer.

13. The heat-sensitive variable-resistance insert device of claim 1 in which said perimetrical member includes a plurality of resilient elements on at least one side.

14. A heat-sensitive variable-resistance insert device for use with a light bulb and socket comprising:

a heat-sensitive variable-resistance wafer for interconnecting the central contact of the socket with the central contact of the light bulb;

a perimetrical insulation member surrounding the edge of said wafer and electrically insulating it from the wall of the socket; and first and second resilient convex disc contacts, one mounted on each side of said wafer and each having an outer edge which contacts said wafer for resiliently engaging the associated central contacts and accommodating for variations in the distance between the central contacts.

15. A heat-sensitive variable-resistance insert device for use with a light bulb and socket comprising:

a heat-sensitive variable-resistance wafer for interconnecting the central contact of the socket with the central contact of the light bulb;

a perimetrical insulation member surrounding the edge of said wafer and electrically insulating it from the wall of the socket;

a resilent perforate contact on at least one side of said wafer for resiliently engaging the associated central contact and accommodating for variations in the distance between the central contacts; and an adhesive paste between said resilient contact and said wafer for adhering said device to the base of a light bulb.

16. A heat-sensitive variable-resistance insert device for use with a light bulb and socket comprising:

a heat-sensitive variable-resistance wafer for interconnecting the central contact of the socket with the central contact of the light bulb;

a perimetrical insulation member surrounding the edge of said wafer and electrically insulating it from the wall of the socket;

a resilient contact on at least one side of said wafer for resiliently engaging the associated central contact and accommodating for variations in the distance between the central contacts; and a two-part catalytically actuated adhesive paste on said resilient contact, the two parts being mounted adjacent to each other for adhering said device to the base of a light bulb.

17. The heat-sensitive variable-resistance insert device of claim 16 in which said paste is viscid and temporarily adheres said wafer to the base until the paste fully sets.

18. A heat-sensitive variable-resistance insert device for use with a light bulb and socket comprising:

a heat-sensitive variable-resistance wafer for interconnecting the central contact of the socket with the central contact of the light bulb;

a perimetrical insulation member surrounding the edge of said wafer and electrically insulating it from the wall of the socket;

a resilient contact on at least one side of said wafer for resiliently engaging the associated central contact and accommodating for variations in the distance between the central contacts; and an adhesive heat setting bonding paste on said resilient contact for adhering said device to the base of a light bulb.

19. A heat-sensitive variable-resistance insert device for use with a light bulb and socket comprising:

a heat-sensitive variable-resistance wafer for interconnecting the central contact of the socket with the central contact of the light bulb;

a perimetrical insulation member surrounding the edge of said wafer and electrically insulating it from the wall of the socket, said perimetrical member including a plurality of resilient members on at least one side thereof; and a resilient contact on at least one side of said wafer for resiliently engaging the associated central contact and accommodating for variations in the distance between the central contacts.

* * * * *